US005655459A

United States Patent [19]

O'Connor et al.

[11] Patent Number: 5,655,459

[45] Date of Patent: Aug. 12, 1997

[54] WALL-MOUNTED FOLD-DOWN SEAT ASSEMBLY

[76] Inventors: Patrick H. O'Connor, 4785 W. 127th Pl., Broomfield, Colo. 80020; Mike M. Peterson, 10908 W. 73rd. St., Shawnee, Kans. 66203

[21] Appl. No.: 484,348

[22] Filed: Jun. 7, 1995

[51] Int. Cl.[6] ..... A47B 5/00

[52] U.S. Cl. ..... 108/48; 108/134

[58] Field of Search ..... 108/42, 47, 48, 108/134

[56] References Cited

U.S. PATENT DOCUMENTS 2,142,263 1/1939 Bentz ..... 108/47

2,636,549 4/1953 Geller ..... 108/48

FOREIGN PATENT DOCUMENTS 2466217 4/1981 France ..... 108/42

*Primary Examiner*—Peter M. Cuomo
*Assistant Examiner*—Gerald A. Anderson
*Attorney, Agent, or Firm*—Gregory J. Nelson

[57] ABSTRACT

A foldable bench type seating assembly is disclosed which may be retracted to a stored out-of-the-way position. A seat support is securable to a wall at a bracket. The seat support is pivotally attached to a leg. When the seating is folded, the seat support moves to a position with the seat cushion outwardly disposed and with the leg also closely adjacent the wall. The seating assembly may be provided with single or multiple level seating.

5 Claims, 4 Drawing Sheets

WALL-MOUNTED FOLD-DOWN SEAT ASSEMBLY

BACKGROUND OF THE INVENTION

1. Field of the Invention

The present invention relates to commercial seating and more particularly relates to bench-type seating which accommodates a number of occupants and which may be retracted or folded to a compact, stored, out-of-the-way position against a supporting surface such as a wall occupying only a small floor area.

2. Description of the Prior Art

Seating such as foldable or retractable bleachers or bench seating for use in auditoriums, gymnasiums and other public facilities are well known. Seating of this type generally must be collapsed and transported to a separate storage area and when it is desired to be used, it must be transported to the use-area, unfolded and erected. This operation is very time-consuming and labor intensive and further requires substantial storage area for the seating when the seating is not erected in a position of use.

Also found in the prior art are various types of folding seating assemblies which are mounted on a wall or vertical support system and which are capable of being collapsed in a position against a wall or within a pocket in the wall so as to be out of the way when not in use. The following patents are representative of such foldable seating.

For example, U.S. Pat. No. 1,784,390 shows a simple chair or seat which is foldable and is adapted for use in dining alcoves and similar locations which has a pivotal connection between the back and the seat portions so that the seat portion can be swung downwardly to assume a position in line with the back of the chair when not in use.

U.S. Pat. No. 3,873,151 shows a wall-hung, fold-down seat and seat stowage support structure for institutional use such as hospitals, prisons and jails. The device eliminates the use of an angle brace for supporting the seat. The seat is contained in a box-like structure. The seat is retained in its vertical or stowed position within the seat stowage pan by means of a locking member. When the seat is in its horizontal use-position, the rear portion of the seat engages the flat surface which stops the seat from further rotation.

Another type of folding seat is shown in U.S. Pat. No. 4,009,903 which has a retractable seat assembly. The seat assembly moves from the open position to the closed position on bearings. When fully closed, the face portion of the seat member is disposed outwardly from the support to provide an attractive and pleasing appearance. The patentee also emphasizes the advantage of having a retractable seat exposed outwardly, particularly in areas such as gymnasiums where injury to occupants is reduced.

Other types of folding seats, particularly for specialized applications such as aircraft and boats can be found in U.S. Pat. Nos. 4,460,215 and 4,916,783, respectively.

Thus, while the prior art shows various types of folding and retractable seats and the prior art even suggests seats in which the cushion portion is disposed outwardly in the folded, non-use position, there nevertheless exists a need for improved bench-type seating which is foldable and which may be used in facilities such as gymnasiums, auditoriums and the like. Many of the prior art seating designs described above are individual seats and not adapted for institutional or commercial installation accommodating a large number of users. There also exists a need for bleacher-type seating configurations which are foldable and which allow users to be positioned at several elevations and which folds into a small envelope which does not interfere with the use of the gymnasium or other area.

Also, the present invention represents an improvement over the prior art in that it provides one or two row seating which folds in contrast to conventional seating which folds only at the third row thereby requiring substantial floor space even when folded.

Accordingly, it is an object of the present invention to provide bleacher-type seating for areas particularly smaller gymnasiums and the like, which seating will accommodate use by a number of persons and which occupies little space when folded.

It is another object of the present invention to provide foldable bench-type seating which has several seating levels and folds to occupy small floor space.

Another object of the present invention is to provide foldable seating for commercial use which seating is simple in design, relatively inexpensive to manufacture and may be installed and maintained easily.

Another object of the present invention is to provide foldable bleacher-type seating for areas, particularly areas such as gymnasiums which in the folded condition the seat cushions are disposed outwardly for improved appearance and for safety.

It is a specific object of the present invention to provide foldable bleacher seating having one or two seating rows, which seating is particularly suited for smaller public areas such as cafeterias and gymnasiums.

SUMMARY OF THE INVENTION

Briefly, in accordance with the present invention, the foldable seating assembly may be secured to any vertical surface such as a wall or bulkhead by a vertical support member. An L-shaped bracket is pivotally secured to the wall support member at one end and at the other is pivotally secured to a seat support member. The seat support member receives a padded cushion seating member on its upper surface. The forward end of the seat support member is pivotally secured to a leg which supports the seat support member and the cushion in a generally horizontal position when in use. When it is desired to store the seat, the pivot bracket is pivoted upwardly which brings the seat cushion to an outwardly disposed position adjacent the horizontal support and in a vertical position close to the wall. The leg depends downwardly along the wall of the floor and may be locked in position at a suitable retainer. The folded seat occupies an envelope of only several inches so as to not interfere with use of the areas as a gymnasium or for other activities.

In the event bench seating is required at several levels, the construction described above is modified so that the leg is of an increased height positioning the seat support at a higher level establishing elevated bench seating. Lower level bench seating is provided by a seating surface on an elongate horizontal rail which is supported at its rear end at a stop bar. The rail has a slot which slidingly receives a pin or pintle which is located at an intermediate location along the leg. The forward end of the horizontal rail extends forwardly of the seating disposed at the higher level and is supported by a pivotal front leg in the use-position.

When multiple level seating is collapsed, the upper level bench seating folds in the manner previously described with respect to a one-level bench seating. The lower level seating also folds and the front leg will pivot inwardly beneath the seating surface, assuming a position adjacent the horizontal rail. The horizontal rail will simultaneously pivot and slide upwardly. The resulting construction assumes a position closely adjacent the vertical supporting surface with both the upper and lower seating disposed outwardly for improved appearance and safety.

The above and other objects and advantages of the present invention will be more apparent from the following description, claims and drawings in which:

Figure 1:
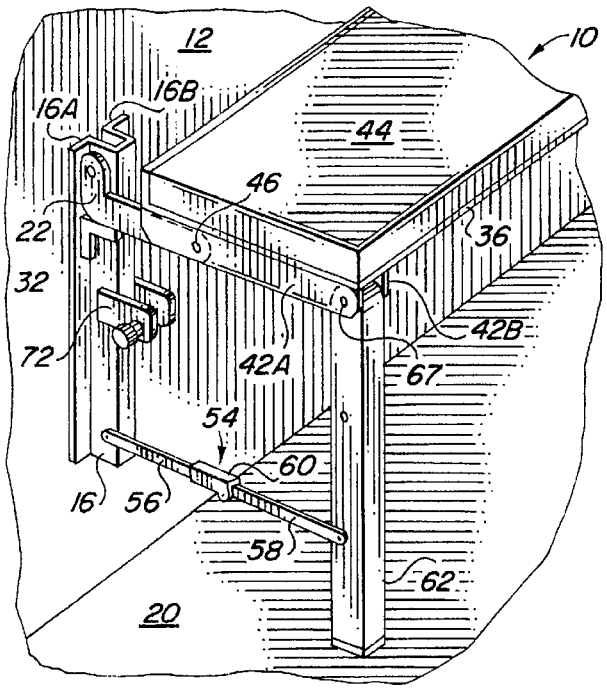
FIG. 1 is a perspective view of a portion of a row of single level bench seating according to one embodiment of the present invention shown in an open position.

Turning now to the drawings, particularly FIG. 1 through 3B and FIGS. 6 and 7, one embodiment of the folding seating assembly of the present invention is shown and is generally designated by the numeral 10. Embodiment 10 is a single row of bench seating for use in facilities such as auditoriums, gymnasiums, cafeterias and the like. The seating is shown secured to a vertical wall or structure 12 by spaced-apart mounting brackets 16 which as best seen in FIG. 1 are U-shaped channels having flanges 16A and 16B secured to the wall 12 by suitable fasteners, not shown, which may be in the form of bolts, lag screw, anchor bolts or the like.

A pivot support 22 is pivotally secured to the upper end of the brackets 16 at a suitable elevation as for example approximately 16"–20" above the floor 20. The support 22 is generally L-shaped having legs 26 which are pivotally secured to opposite sides of bracket 16 at pivot pin 30. Legs 24 of the pivot support are elongated and in the use-position, extend generally horizontally. A stop plate 32 is mounted to wall 12 and abuts the lower horizontal surface of the leg bracket to support legs 24 in a horizontal position.

A bench surface or deck 36 is supported at intervals by braces 42, each consisting of a pair of spaced-apart angle supports 42A and 42B. One leg of each of the supports 42A, 42B is secured to the underside of the seat surface or deck 36 by suitable fasteners such as screws. The opposite legs depend from the seat are spaced apart extending along the outer sides of the pivot support 22. The L-shaped pivot support 22 and the seat support members 42 are pivotal with respect to one another about pivot pin 46. Pivot pin 46 is located forwardly approximately one-third of the length of the seat support members 42.

Figure 2A:
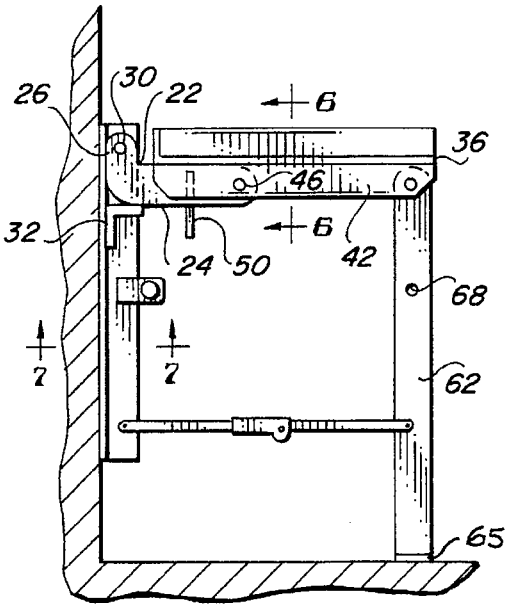
FIGS. 2A–2D illustrate the sequence of operations that take place when the bench of FIG. 1 is folded to a stored position.
Figure 2D:
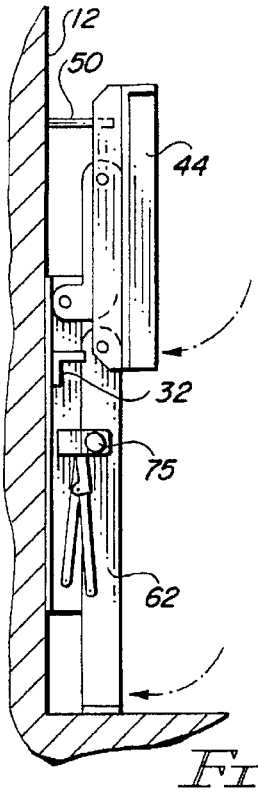
Figure 2C:
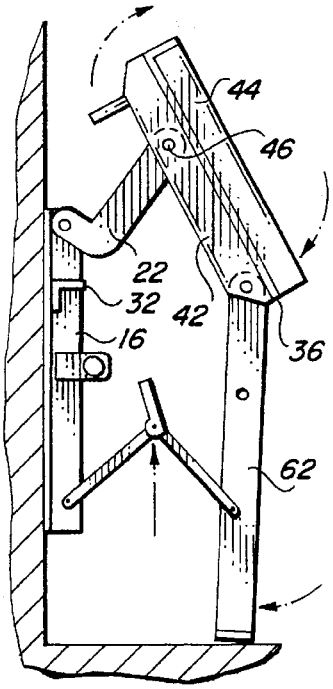
Figure 2B:
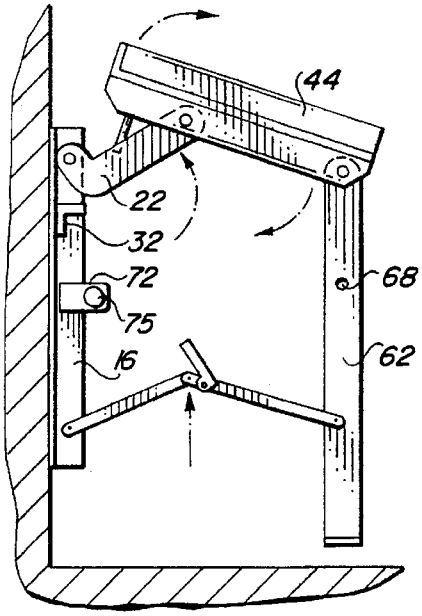

The upper surface of the bench surface or deck 36 supports a cushion 44 which may be a resilient foam pad covered by a suitable material such as a vinyl or polyurethane. The seat cushion 44 may be secured in place by adhesive or by use of mechanical fasteners. A stand-off brace 50 depends from the underside of the bench surface or deck at spaced-apart locations to engage the wall 12 in the collapsed or folded position as seen in FIG. 2D.

A foldable brace 54 has members 56, 58 which are pivotally joined at an intermediate location at pivot pin 60 extend in a horizontal position between the leg 60 and the wall when the bench seating is unfolded in a use-position.

A leg 62 is pivotally attached between the forward end of seat support members 42A and 42B at pivot pin 67. The leg 62 has a pad 65 at its lower end of rubber or other resilient material. Leg 62 may be wrapped or coated with a resilient, protective padding material for safety.

Figure 7:
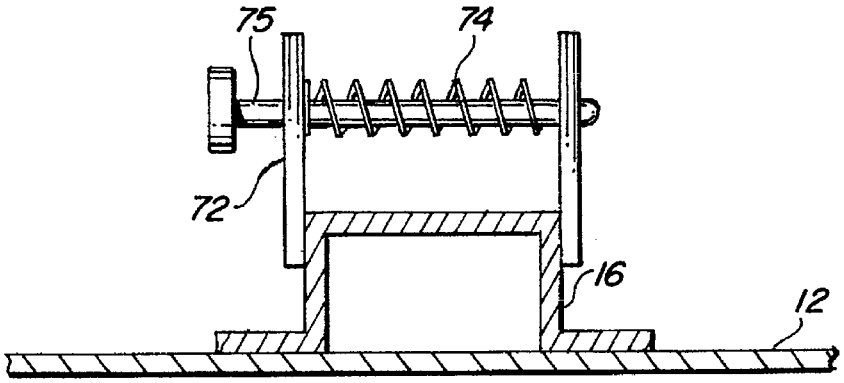
FIG. 7 is a sectional view taken along line 7—7 of FIG. 2A.
Figure 8:
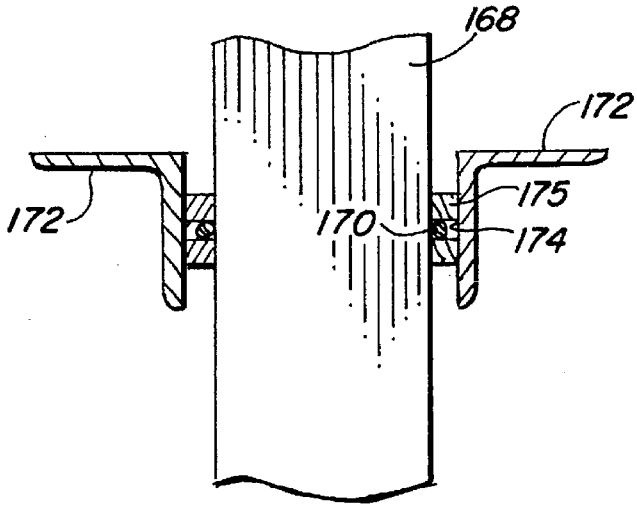
FIG. 8 is a sectional view taken along line 8—8 of FIG. 4A.

The front leg 62 defines a transversely extending bore 68 which, in the folded position, aligns with a retainer plate 72 and secured to the support bracket 16. As best seen in FIG. 7, spring biased detent pin 75 registers with bores 68 to secure the seating in a folded position. The detent pin may be moved leftward compressing spring 74 as seen in FIG. 7 to allow insertion of leg 62. Pin 75 is then released to register with bore 68.

In use, any number of bench seat sections may be provided as required. The sections may be of any suitable length with an overall length. Seating units would be typically mounted to a wall surface 12 such as the wall of a gymnasium or cafeteria. An advantage of the foldable seating system of the present invention is that the seating may be folded to a compact storage position against the wall with the resilient cushion 44 disposed outwardly for improved appearance and also to provide a padded surface for the safety of occupants who may contact the seat in the area of the cushion. The advantage of providing an exteriorly positioned cushioning surface when the seating assembly is folded is particularly advantageous in the case of seating used in gymnasiums where physical activity occurs. The seating in a folded condition occupies only a few inches of space outward of the wall.

FIGS. 2A through 2D illustrate the steps in folding the seating to an out-of-the-way position. Initially brace 60 is folded by pivoting the legs 56, 58 relative to one another. The bench 36 is then pivoted upwardly which can be manually accomplished by one or more individuals. Lifting the bench upwardly will cause the seat supports 42 and the brackets 22 to pivot relative to one another about pivot 46. The cushion 44 moves upwardly as the bench deck 36 is moved rearwardly with the cushion assuming a vertical position as shown in FIG. 2D. The stand-off 50 will engage the wall 12 to maintain the cushion in a generally vertical position when folded. Leg 62 assumes a vertical position against the wall support with bore 68 registering with detent 75. The user will insert the spring-biased detent 75 in position in bore 68 in leg 62 to secure the seating assembly in the folded position.

Figure 3A:
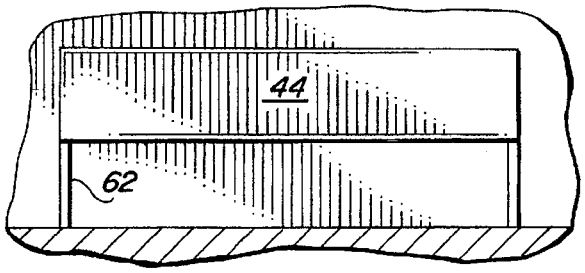
FIG. 3A is an elevational view showing the seating folded.
Figure 3B:
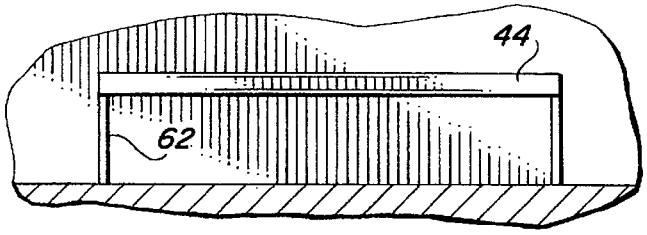
FIG. 3B is an elevational view showing the seating open.

FIG. 3A shows the front or elevational view of the seating when folded and FIG. 3B is a similar view in an open or deployed position.

FIGS. 4A to 5B and FIG. 8 show another embodiment of the present invention which has generally been designated by the numeral 100 and illustrates the present invention applied to multiple row seating in which seating surfaces are provided at two elevations. In this embodiment, the folding seating assembly is again provided in sections of any convenient length with each section being supported by brackets 116 and supports 122 at spaced-apart locations. Each of the support members consists of a wall-mounted bracket 116 which are similar to those described above and are shown as a general U-shaped channels having opposite flanges which are secured to the wall 12 by fasteners such as anchor bolts and the like. In this embodiment, a two-level bleacher-type bench seating is shown. The upper level of the bench seat is positioned at a suitable elevation above the floor 2O surface 20. The upper seating level is supported by spaced-apart pivot brackets 122 each having a shorter leg 126 which is pivotally attached at pivot pin 130 to the upper end of the support 116. Each bracket has a horizontal leg 124 which extends at right angles with respect to leg 126 and is pivotally secured to seat support 142. Pivot bracket 122 is preferably constructed having a tubular configuration. The seat supports 142 consist of a pair of oppositely disposed angles extending along opposite sides of the pivot bracket 122 and pivotal with respect to the bracket at pivot pin 146.

The upper surface of the seat support 142 has a bench or deck 136 which supports a seat cushion 144. The deck is substantially continuous and may be wood or metal. A leg 168 depends downwardly in the deployed or use-position being pivotally attached at its upper end to the forward end of the support 142 at pivot 162. The construction described above is essentially identical to that shown in FIG. 1 with the exception the seat is positioned at a higher elevation since the seat is the upper level of a two-level bench seat.

At an intermediate location, as for example approximately 16" to 20" above the floor surface 20, a pair of oppositely extending pins 170, are provided on leg 168. Lower seat support 172 is provided with an elongate slot 174 which receives the pin 170. It is preferred that the support 172 comprise opposed angles and that slot 170 be provided in elongate bearing member 175 horizontally disposed along the interior faces of the angles 172. This is best seen in the cross sectional view of FIG. 8.

In the erected or use-position, the inner end of support 172 rests on a stop 178 in the form of a short section of angle, welded or otherwise secured to the wall 12. A front leg 182 is pivotally secured to the outer end of the support 172 at pivot pin 184. A lower bench or deck area 185 is disposed on the upper surface of the support 172. One or more cushion sections 186 and 188 are provided on the upper surface of the deck for comfort and safety.

Figure 5A:
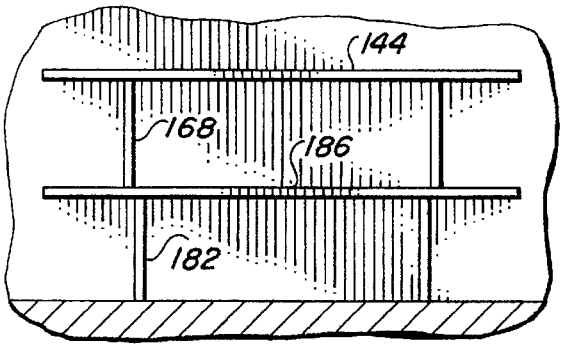
FIG. 5A is an elevational view of the seating of FIG. 4A in an open position.
Figure 5B:
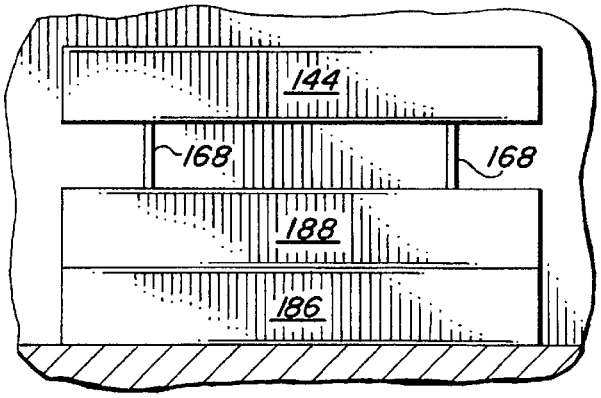
FIG. 5B is an elevational view of the seating of FIG. 4A in a collapsed or folded position.
Figure 4C:
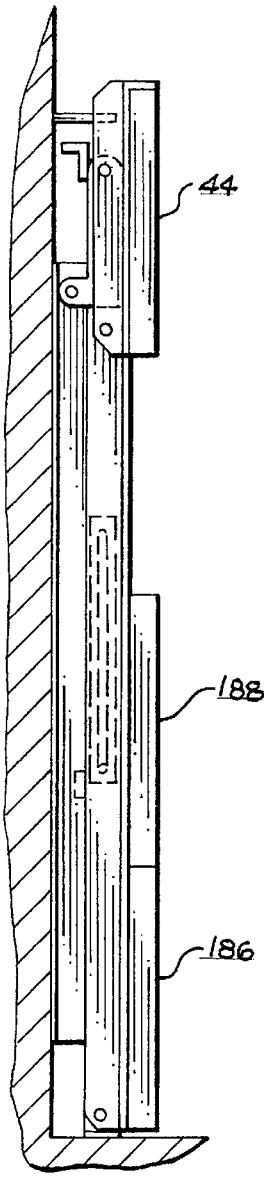
FIGS. 4B and 4C show the sequential operations in moving the seating of FIG. 4A to a compact folded position.
Figure 4A:
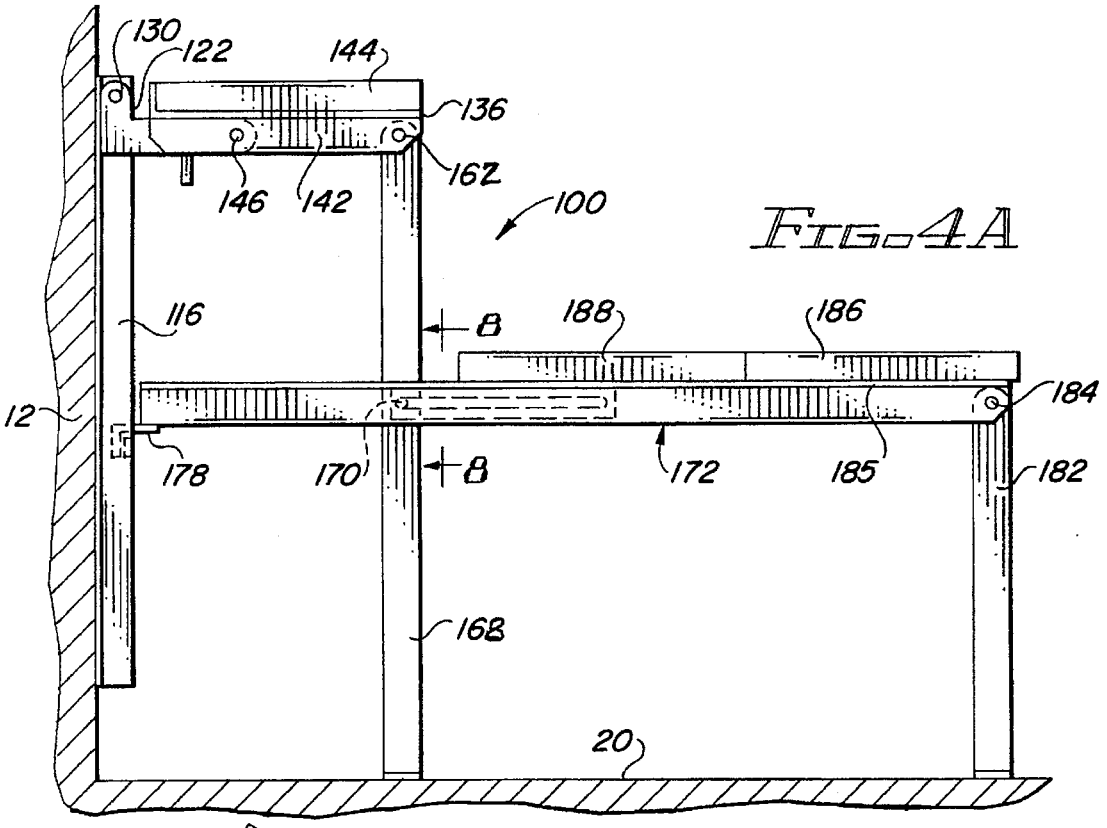
FIG. 4A is a side view of an alternate embodiment of the present invention in which the foldable seating of the invention provides rows of bench seating at two elevations.
Figure 4B:
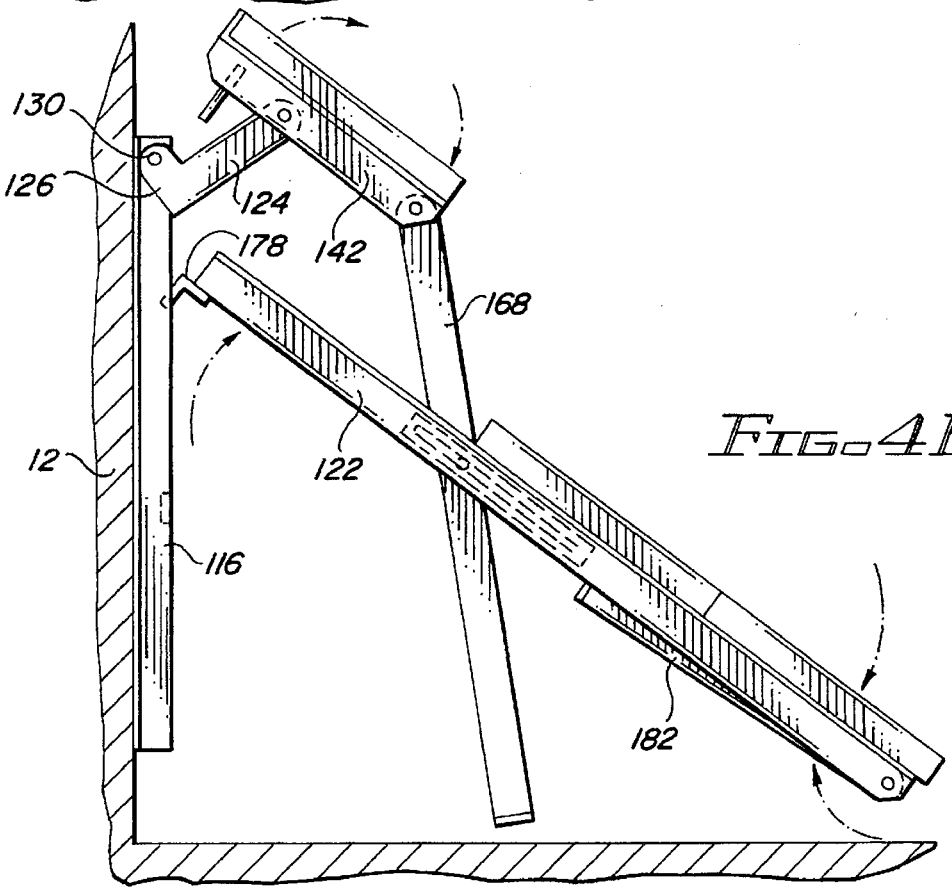
Figure 6:
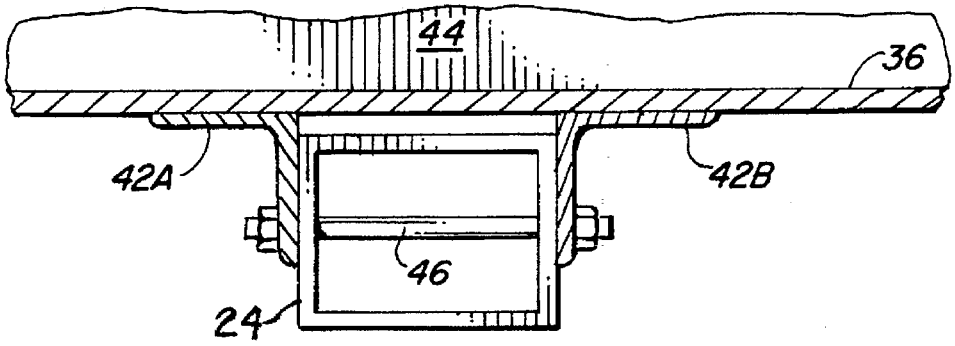
FIG. 6 is a sectional view taken along lines 6—6 of FIG. 2A.

In the use or deployed position, the multiple row bench seating is as shown in FIGS. 5A and 5B. When it is necessary to fold the bleachers to an out-of-the-way position seen in FIG. 5B, the area formerly occupied by the seating may be used for other purposes, workers will first fold the legs 182 inward and upwardly to a position along the lower support member 172. The lower support member 172 is then simultaneously pivoted upwardly and moved inwardly which move is facilitated by the pin 174 engaging elongate slot 175. When the lower support member and leg 180 have assumed a generally vertical position, the upper bench 136 can be pivoted upwardly and outwardly while simultaneously pivoting pivot bracket upwardly and inwardly. This will result in the leg member 168 assuming a vertical position adjacent the vertical wall bracket. Both the seat cushion on the upper seating row and the lower seat cushions are disposed outwardly for safety and appearance as seen in FIG. 5B.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

We claim:

1. A bench-style folding seat for attachment to a vertical surface comprising:

(a) a generally U-shaped surface mounting bracket securable to said vertical surface in a generally vertical position;

(b) a pair of pivot members having first and second arms disposed in an L-shaped configuration, said pivot members being pivotally secured to said pivot bracket at their first arms at opposite sides of said bracket;

(c) a seat support member having a supporting surface and being pivotally secured to the second arms of said pivot members at a location intermediate a first and a second end of said seat support member; and (d) a first leg pivotally secured to the second end of said seat support member whereby in a use-position, said supporting surface is supported in a generally horizontal position with said seat support member being in a horizontal position with said first arm abutting said bracket and with said first leg positioned vertically and whereby said folding seat may be folded to a compact storage position adjacent said vertical surface with a seat supporting surface of said supporting member disposed outwardly of said bracket and said leg extending vertically adjacent said vertical surface and with said seat support member, said first leg and said second arm of said pivot members being in substantially vertical alignment.

2. The bench-style seat of claim 1 further including stop means associated with said bracket and engaging said pivot member when said bench-style folding seat is in said use position.

3. The bench-style folding seat of claim 1 further including retainer means for securing said bench seat in said folded position.

4. The bench-style folding seat of claim 1 further including resilient seat cushions disposed on said seat support member.

5. The bench-style folding seat of claim 1 further including foldable brace means extending between said bracket and said front leg.

* * * * *